United States Patent [19]

Schutte

[11] 4,008,857

[45] Feb. 22, 1977

[54] SCREEN MILL

[75] Inventor: Harry D. Schutte, Amherst, N.Y.

[73] Assignee: Schutte Pulverizer Co., Inc., Buffalo, N.Y.

[22] Filed: June 10, 1976

[21] Appl. No.: 694,556

[52] U.S. Cl. ..... 241/89.2
[51] Int. Cl.[2] ..... B02C 23/16
[58] Field of Search ..... 241/73, 86, 89.2, 89.3

[56] References Cited

UNITED STATES PATENTS

| | | | |
|---|---|---|---|
| 2,640,650 | 6/1953 | Jacobson | 241/89.2 |
| 2,706,087 | 4/1955 | Frangquist | 241/89.2 |
| 2,829,839 | 4/1958 | Schutte | 241/89.2 |

*Primary Examiner*—Granville Y. Custer, Jr.
*Attorney, Agent, or Firm*—Bean & Bean

[57] ABSTRACT

A hammer mill features a screen mounting arrangement in combination with a mill casing door arrangement facilitating insertion/removal of the screen.

6 Claims, 3 Drawing Figures

SCREEN MILL

BACKGROUND OF THE INVENTION

Hammer mills of the radial feed variety conventionally include a hammer mounting rotor, which is supported for rotation within a casing defining material inlet and discharge openings; and a screen device, which is removably mounted within the casing to bound the rotor and to define a screen inlet opening aligned with the casing inlet opening.

When hammer mills of this general type employ a cantilever supported rotor, insertion/removal of the screen is greatly facilitated by forming the casing with a hinged side wall construction of the type disclosed in my prior u.S. Pat. No. 3,389,862, which permits the screen to be inserted in a direction aligned with its rotational axis.

However, cantilever supported rotors have certain structural/performance limitations, and thus it is often necessary to support the rotor by means of a pair of bearings arranged on axially opposite sides of the casing. This in turn necessitates that the casing and screen be formed so as to permit insertion of the screen in a direction extending transversely of the rotor axis. Over the years many proposals have been made for facilitating insertion/removal of the screen devices in a direction extending transversely of the rotor axis; U.S. Pats. Nos. 954,540; 1,759,448; 2,946,523 and 3,893,632 being cited as being representative of mills employing hingedly connected screens or screen supports in an attempt to facilitate insertion/removal of the screen devices. However, these prior attempts are not wholly satisfactory in view of either their complexity of construction and/or in that they do not permit unassisted, single operator insertion/removal of the screen device.

SUMMARY OF THE INVENTION

The present invention relates to hammer mills and more particulary to an improved hammer mill screen mounting arrangement in combination with a casing door arrangement, which facilitates insertion/removal of the screen device within the casing of the hammer mill.

DRAWINGS

The nature and mode of operation of the present invention will now be more fully described in the following detailed description taken with the accompanying drawings wherein.

DETAILED DESCRIPTION

Figure 1:
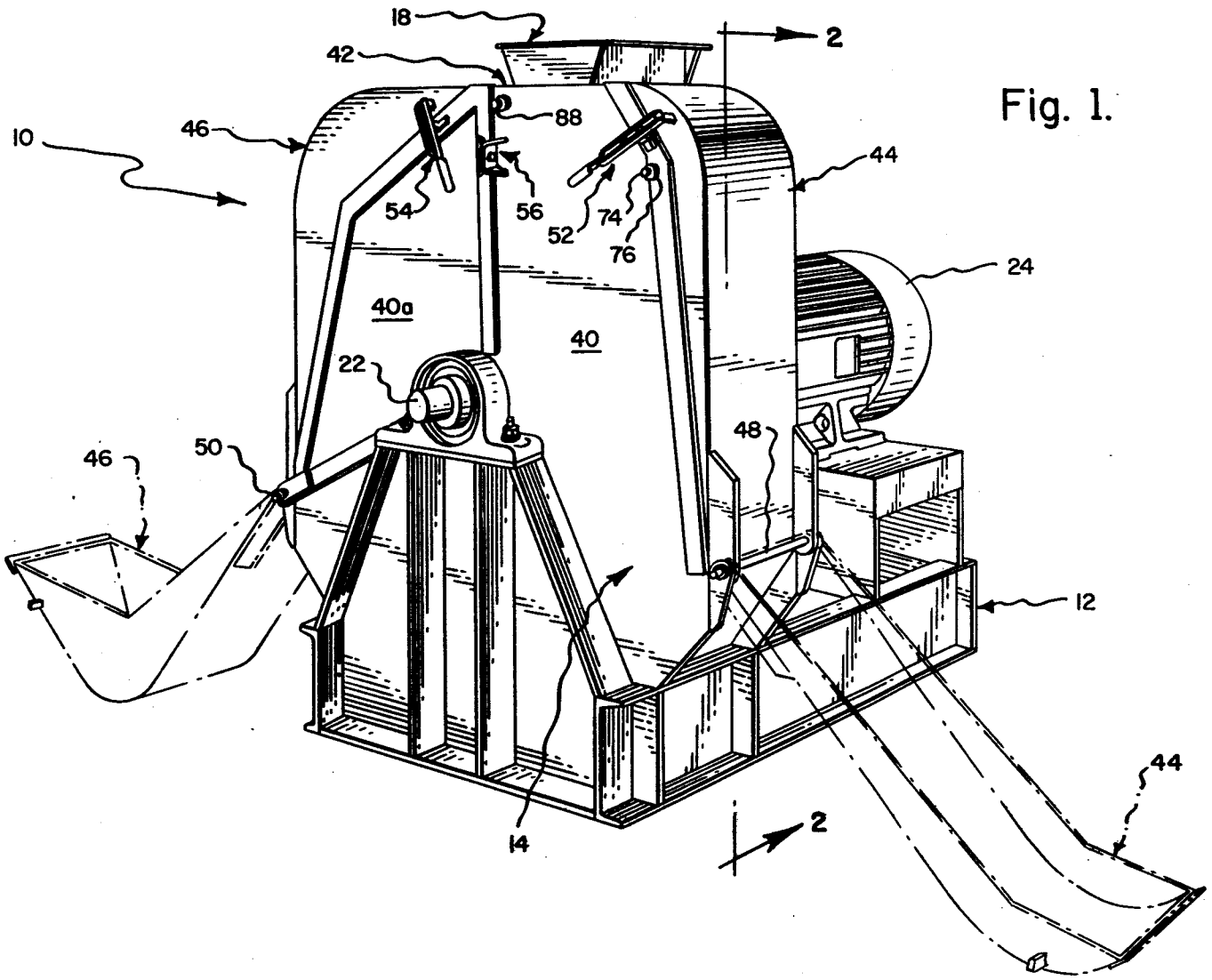
FIG. 1 is a perspective view of a hammer mill incorporating the present construction.
Figure 2:
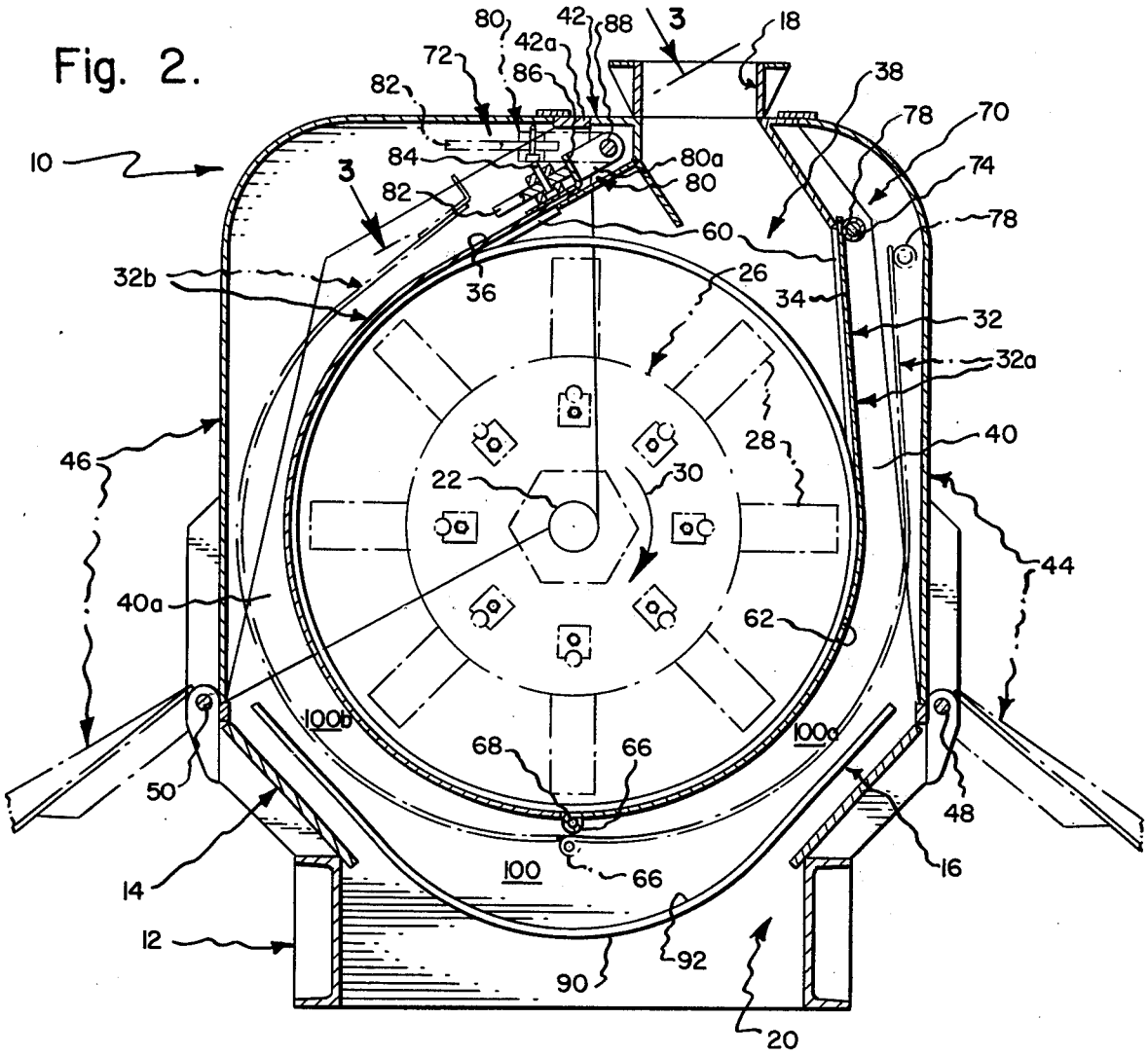
FIG. 2 is a sectional view taken generally along the line 2—2 in FIG. 1.

Reference is now made to FIGS. 1 and 2, wherein a hammer mill embodying the present invention is generally designated as 10 and shown as including a base or supporting framework 12; a base mounted casing 14, which serves to bound a material treating chamber 16 having an upper material inlet opening 18 and a lower material discharge or outlet opening 20; a drive shaft 22, which is suitably supported to extend horizontally through chamber 16 and adapted to be driven for rotation by suitable means, such as a base mounted electric motor 24; a conventional rotor assembly 26, which is suitably fixed for rotation with drive shaft 22 within chamber 16 and includes a plurality of hammers 28 arranged for movement along a path of travel disposed concentrically of the axis of drive shaft 22 in the direction indicated by arrow 30; and a generally arcuately shaped screen device 32, which is mounted within chamber 16 outwardly of the path of travel of hammers 28 and has its opposite ends 34 and 36 spaced to define a screen inlet or opening 38 arranged in communication with inlet opening 18.

Hammer mills of the type thus far described are conventional and are commonly employed to pulverize diverse materials. Thus, it is believed sufficient for the understanding of the present invention to merely indicate that material to be pulverized may be suitably introduced into the confines of screen device 32 through aligned openings 18 and 38, whereupon hammers 28 serve to reduce the material to particles sized to pass through screen device 32 for subsequent discharge through outlet opening 20.

In accordance with the present invention, casing 14 is defined by a pair of opposite side walls 40 and a multiple part cover 42, which extends between the side walls and cooperates therewith to define chamber 16 and openings 18 and 20. More specifically, cover 42 includes a pair of horizontally oppositely arranged, and vertically elongated access doors 44 and 46, which are hingedly connected adjacent their lower ends to side walls 40 by hinge pin devices 48 and 50, respectively, for downwardly and outwardly directed opening movements, as indicated in broken line in FIGS. 1 and 2, in order to afford access to chamber 16 for the purpose of permitting insertion/removal of screen device 32 in the manner to be described. Doors 44 and 46 may be normally retained in their access opening closed positions shown in full line in FIGS. 1 and 2 by means of conventional side wall mounted latch devices 52 and 54, respectively. As will be apparent from viewing FIG. 2, the present design of casing 14 is such that the chamber access openings normally covered by doors 44 and 46 are expansive and extend substantially between inlet and discharge openings 18 and 20.

In a preferred form of the present invention, insertion/removal of rotor assembly 26 and drive shaft 22 is facilitated by cutting side walls 40 to define a pair of access panels **40*a*, which are rigidly interconnected adjacent their upper ends by a cover cross piece or member 42*a* and hingedly supported adjacent their lower ends on hinge pin device 50. Panels 40*a* would normally be locked in their closed position shown in the drawings by means of removably bolt connected flange devices 56**.

Again referring to FIG. 2, it will be understood that ledge devices 60 are fixed to the inwardly facing surface of each side wall 40 to project inwardly of chamber 16. Ledge devices 60 serve to define generally arcuately shaped and relatively aligned bearing surfaces 62, which are disposed to face radially outwardly relative to the axis of drive shaft 22 and to extend circumferentially of rotor 26 intermediate the path of travel of hammers 28 and cover 42 between opposite sides of inlet opening 18.

Figure 3:
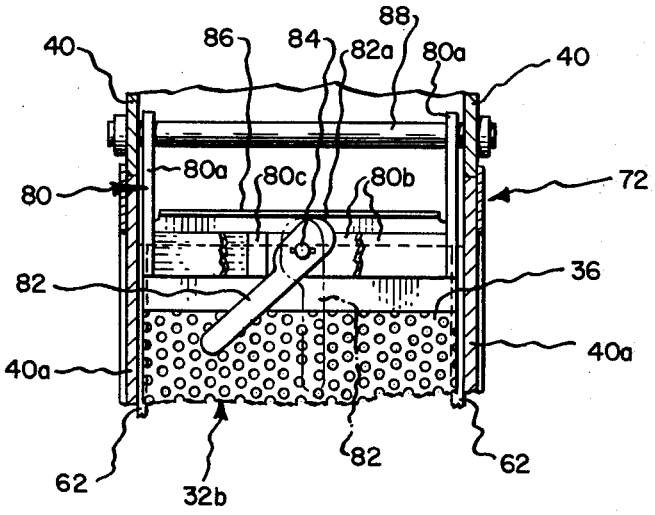
FIG. 3 is a sectional view taken generally along the line 3—3 in FIG. 2.

Screen device 32 is shown in FIGS. 2 and 3 as being of a generally arcuate shaped configuration and sized to bridge essentially between side walls 40 for opposite marginal edge bearing engagement with bearing surfaces 62 and to extend essentially between the opposite sides of inlet opening 18. In a preferred form of the present invention, screen device 32 is divided approximately in half to define two arcuately shaped screen sections 32*a* and 32*b*, which in turn serve to define opposite ends 34 and 36, respectively of the screen device. Screen sections 32*a* and 32*b* are shown in FIG. 2 as having their adjacent ends removably hinge connected, such as by forming such adjacent ends with interdigitated curls 66, which are sized to removably slide fit receive a hinge pin 68.

Screen device 32 is shown in FIG. 2 as being removably mounted witin chamber 16 by means of side wall affixed mounting and clamping devices 70 and 72, respectively. More specifically, mounting device 70 is shown as being in the form of a rod 74, which is sized to be removably end supported within aligned apertures defined by side wall mounted bearing bosses 76, and a sleeve device 78, which is suitably fixed to end 34 of screen section 32*a* and sized to removably slide fit receive rod 74. It will be understood that, when mounting device 70 is is in its assembled condition shown in FIG. 2, rod 74 is disposed essentially parallel to the axis of drive shaft 22 and the inwardly facing surface of screen end 34 is disposed for abutting engagement with the end of bearing surfaces 62 adjacent the right hand side of opening 18, as viewed in FIG. 2.

Clamping device 72 includes a generally U-shaped bracket device 80 having a pair of leg portions 80*a*, which are connected to opposite ends of a pair of parallel mounting bars 80*b*, which are in turn interconnected by one or more stop blocks 80*c;* a clamping or cam lever 82, which is formed with a cam surface 82*a* and supported intermediate mounting bars 80*b* for rotational or pivotal movements relative thereto by a pivot pin 84; and a generally L-shaped latching flange 86, which is suitably fixed to upstand from end 36 of screen section 32*b*.

Bracket 80 is supported for movements about a hinge axis arranged essentially parallel to the axis of drive shaft 22 between clamping and release positions shown in full and broken line, respectively, in FIG. 2 by means of a side wall mounted hinge pin 88 received within aligned openings formed in leg portions 80*a*. Pivot pin 84 serves to support clamping lever 82 for rotational or pivotal movements about a clamping axis arranged normal to the axis of hinge pin 88 between its clamping and release positions shown in full and phantom line, respectively, in FIG. 3. By viewing FIG. 2, it will be understood that clamping lever 82 is alternately removed from and arranged for clamping engagement with latching flange 86 when bracket device 80 is in its release and clamping positions, respectively, and that when bracket device 80 is in its clamping position, clamping lever 82 is aligned for clamping engagement with latching flange 86 and rotatable about the axis of pivot pin 84 between its release and clamping positions. When clamping lever 82 is moved into its clamping position, cam surface 82*a* is caused to bear on latching flange 86 and exert a force thereon tending to move the latching flange in a direction towards hinge pin 88, whereby to draw screen device 32 into bearing engagement with bearing surfaces 62. By viewing FIG. 3, it will be understood that rotations of clamping lever 82 beyond its clamping position in a clockwise sense is prevented, due to engagement thereof with stop block 80*c*, and that the clamping lever is prevented from returning to its release position absent the application of operator force thereto, due to the 'overcenter' positioning of cam surface 82*a*.

Again referring to FIG. 2, it will be understood that a pair of generally arcuately shaped support bars 90 are fixed to facing surfaces of guide walls 40 vertically beneath rotor 26 and sized to extend substantially intermediate the lower ends of the access openings to be closed by doors 44 and 46. Bars 90 serve to define aligned and generally upwardly facing support surfaces 92, which are arranged in a spaced apart facing relationship relative to bearing surfaces 62. Surfaces 92 and 62 cooperate to define a guide channel 100 having open ends 100*a* and 100*b* through which screen device 32 may be removably inserted incident to installation/-removal of the screen device from chamber 16.

Screen device 32 would normally be installed by a procedure involving inserting one or the other of screen sections 32*a* and 32*b* into guide channel 100 sufficiently to support same on surfaces 92, while allowing its curls 66 to project outwardly through one of the access openings. The other screen section may then be temporarily supported on the access door normally covering such access opening to free the hands of an operator to insert hinge pin 68 for the purpose of joining the screen sections together. The assembled screen sections would then be roughly centered within channel 100 and the screen device end 34 lifted and positioned to allow insertion of rod 74 through sleeve device 78. Bracket device 80 would then be swung upwardly into its release position and latching flange 86 lifted and positioned for engagement by clamping lever 82 when the bracket device is subsequently returned to its clamping position, as indicated in full line in FIG. 2. Installation would be completed by manually rotating clamping lever 82 into its clamping position shown in full line in FIG. 3. Screen devices 32*a* and 32*b* may be removed by simply reversing the foregoing installation operation.

I claim:

1. A hammer mill comprising in combination:

a casing bounding a chamber and having upper material inlet and lower material discharge openings communicating with said chamber, said casing being defined by opposite side walls and a cover extending between said side walls, said cover having horizontally opposite portions thereof defining access doors for affording operator access to said chamber intermediate said inlet and discharge openings;

a horizontally disposed and rotatable drive shaft projecting through said side walls;

a rotor assembly fixed for rotation with said drive shaft within said chamber and including a plurality of hammers arranged for movement along a path of travel disposed concentrically of the axis of said drive shaft;

generally arcuately shaped ledge means fixed one to each of said side walls to project inwardly of said chamber, said ledge means defining generally aligned bearing surfaces disposed to face outwardly of said axis and extend circumferentially of said rotor intermediate said path of travel and said cover between opposite sides of said inlet opening;

a generally arcuately shaped screen device sized to bridge essentially between said side walls for opposite marginal edge bearing engagement with said bearing surfaces and to extend essentially between said opposite sides of said inlet opening;

a mounting device carried by said casing adjacent one on said opposite sides of said inlet opening for removably mounting one end of said screen device;

a clamping device carried by said casing adjacent a second of said opposite sides of said inlet opening for removably mounting an opposite end of said screen device and for drawing said screen device intermediate its ends into bearing engagement with said bearing surfaces, said screen device including at least two arcuately shaped and end-to-end connected screen sections, said screen sections having their adjacent ends hingedly connected, said access doors normally covering access openings arranged to afford access one to each of said mounting device and said clamping device and sized to permit removable insertion of at least one of said screen sections therethrough.

2. A hammer mill according to claim 1, wherein said adjacent ends of said screen sections are removably hinge connected.

3. A hammer mill according to claim 1, wherein support means are fixed to facing surfaces of said side walls, said support means being arranged in a radially outwardly spaced relationship relative to said ledge means and disposed vertically therebelow, whereby to afford support for said screen device intermediate said ends thereof when released from bearing engagement with said bearing surfaces during insertion/removal of said screen device.

4. A hammer mill according to claim 1, wherein said mounting device includes a rod removably end supported within aligned apertures formed in said side walls to extend essentially parallel to said axis, and said one end of said screen device has a sleeve device fixed thereto, said sleeve device being dimensioned to removably slide fit receive said rod.

5. A hammer mill according to claim 1, wherein said clamping device includes a bracket device hinge connected to said side walls for pivotal movements about the hinge axis arranged essentially parallel to said axis between clamping and release positions, a clamping lever fixed to said bracket device for rotation about a clamping axis arranged normal to said hinge axis between clamping and release positions, and a latching flange fixed to upstand from said opposite end of said screen device, characterized in that said clamping lever is alternately removed from and arranged for clamping engagement with said latching flange when said bracket device is in said release and clamping positions, respectively, and in that when said bracket device is in said clamping position, said clamping lever is aligned for clamping engagement with said latching flange and rotatable from its release position into its clamping position to bear on said latching flange and exert a force thereon tending to move said latching flange in a direction towards said hinge axis, whereby to draw said screen device into bearing engagement with said bearing surfaces.

6. A hammer mill according to claim 1, wherein said access doors have lower ends thereof hinge supported on said side plates for downwardly and outwardly directed opening movements and their upper ends releasably latched to said side walls, support means are fixed to facing surfaces of said side walls, said support means defining generally arcuately shaped support surfaces arranged in a spaced apart facing relationship relative one to each of said bearing surfaces and to extend essentially between lower ends of said access openings normally covered by said doors, whereby to afford a guide-support for said marginal edges of said screen device when released from bearing engagement with said bearing surfaces during insertion/removal of said screen device, said screen device, said screen sections having said adjacent ends removably hinge connected, said mounting device includes a rod removably end supported within aligned apertures formed in said side walls to extend essentially parallel to said axis, said one end of said screen device has a sleeve device fixed thereto, said sleeve device being dimensioned to removably slide fit receive said rod, and said clamping device includes a bracket device hinge connected to said side walls for pivotal movements about the hinge axis arranged essentially parallel to said axis between clamping and release position, a clamping lever fixed to said bracket device for rotation about a clamping axis arranged normal to said hinge axis between clamping and release positions, and a latching flange fixed to upstand from said opposite end of said screen device, characterized in that said clamping lever is alternately removed from and arranged for clamping engagement with said latching flange when said bracket device is in said release and clamping positions, respectively, and in that when said bracket device is in said clamping position, said clamping lever is aligned for clamping engagement with said latching flange and rotatable from its release position into its clamping position to bear on said latching flange and exert a force thereon tending to move said latching flange in a direction towards said hinge axis, whereby to draw said screen device into bearing engagement with said bearing surfaces.

* * * * *